US008201990B2

(12) United States Patent
Sykora et al.

(10) Patent No.: US 8,201,990 B2
(45) Date of Patent: Jun. 19, 2012

(54) MIXING IMPELLER

(75) Inventors: Anthony C. Sykora, Hudson, NH (US); Bruce R. Crossley, Pittsfield, MA (US); Joseph A. Ducharme, Milford, NH (US); James P. Burns, Hollis, NH (US)

(73) Assignee: Ovivo Luxembourg S.à r.l., Munsbach (LU)

( * ) Notice: Subject to any disclaimer, the term of this patent is extended or adjusted under 35 U.S.C. 154(b) by 870 days.

(21) Appl. No.: 12/247,944

(22) Filed: Oct. 8, 2008

(65) Prior Publication Data

US 2010/0086410 A1 Apr. 8, 2010

(51) Int. Cl.
*B01F 7/22* (2006.01)
*B02C 13/28* (2006.01)

(52) U.S. Cl. ..... 366/330.7; 241/297; 241/46.17; 366/297; 366/330.3; 366/342

(58) Field of Classification Search ..... 241/46.1, 241/46.17, 292.11, 297; 366/330.1, 330.3, 366/330.7, 342, 15, 17
See application file for complete search history.

(56) References Cited

U.S. PATENT DOCUMENTS

| | | | | |
|---|---|---|---|---|
| 3,073,535 | A | 1/1963 | Vokes | |
| 3,163,368 | A * | 12/1964 | Johnson | 241/46.17 |
| 3,342,425 | A * | 9/1967 | Morton | 241/46.17 |
| 3,843,063 | A | 10/1974 | Honeyman | |
| 3,889,885 | A * | 6/1975 | Couture | 241/46.11 |
| 3,946,951 | A * | 3/1976 | Danforth | 241/21 |
| 4,109,872 | A * | 8/1978 | Couture | 241/46.11 |
| 4,480,796 | A | 11/1984 | Paraskevas | |
| 4,593,861 | A * | 6/1986 | Blakley et al. | 241/46.02 |
| 4,721,394 | A * | 1/1988 | Casto et al. | 366/343 |
| 5,785,424 | A * | 7/1998 | Noda et al. | 366/317 |
| 5,791,780 | A * | 8/1998 | Bakker | 366/317 |
| 5,918,822 | A * | 7/1999 | Sternby | 241/46.17 |
| 6,508,422 | B2 * | 1/2003 | Wickensberg et al. | 241/46.17 |
| 6,866,414 | B2 * | 3/2005 | Kupidlowski | 366/330.3 |
| 2005/0224610 | A1 * | 10/2005 | Egan et al. | 241/46.17 |
| 2006/0171804 | A1 | 8/2006 | Brown | |

FOREIGN PATENT DOCUMENTS

EP 1594597 A2 8/2004

* cited by examiner

*Primary Examiner* — Joseph Del Sole
*Assistant Examiner* — Nahida Sultana
(74) *Attorney, Agent, or Firm* — James Earl Lowe, Jr.

(57) ABSTRACT

An impeller for use in association with an extraction plate adapted for defibering liquid slurry stock and causing defibered material to pass through the extraction plate. The impeller includes a cylindrical central body portion and a plurality of vanes extending outwardly in a generally tangential direction from the central body portion. The vane leading face height from an extraction side to an air foil surface is substantially constant from the vane outer end to where the vane is attached to the central body portion at the radially outward edge of the central body portion, and then thereafter gradually decreasing in height from the radially outward edge of the body central portion to the airfoil surface at the vane inner end.

10 Claims, 5 Drawing Sheets

MIXING IMPELLER

BACKGROUND

This disclosure relates to the field of pulping machinery for defibering papermaking stock, and more particularly, to an improved mixing impeller.

The traditional pulper impeller has two separate functions, first, defibering the stock suspension and second, efficient circulation of the suspension to keep it homogeneous. While pulping impellers of various forms have been described in the prior art, such impellers normally represent a compromise between efficient defibering and efficient circulation.

FIG. 1 shows a conventional pulping, mixing, or defibering apparatus, which generally includes a vat, or tub, 10 formed of side wall 11 and bottom wall 12. In the center of the bottom wall 12 is a perforated strainer grate 13. The strainer grate 13 permits draining of pulped paper stock, for example, after a pulping operation is completed. An impeller 15 for circulating the paper stock, for example, or other material, is mounted on a hub 14 in the center of the strainer grate 13. Supports 19 stabilize the pulping tub, or vat, 10.

The impeller 15 creates a mechanical shear and/or hydraulic shear effect on the pulp, or other material, being mixed. Mechanical shear, for example, is achieved by rotating the impeller 15 above and in close proximity to the stationary strainer grate 13 so that the paper pulp stock, or other material, is defibered or separated into individual fibers as a result of the shearing action between the strainer grate 13 and the underside of the vanes 17 of the impeller 15. Hydraulic shear, on the other hand, occurs by contacting the paper pulp fibers, for example, with other paper pulp fibers in the tub, or vat, 10 as a result of the turbulence, or flow pattern, generated by rotation of the impeller 15. Gears that engage the hub 14 drive the impeller 15. A motor 22 powers the gears that are housed within gear housing 20.

SUMMARY

One of the principal objects of this disclosure is to provide an improved impeller for a pulping assembly which is used for the defibering of waste paper, dry pulp furnishes, broke pulping, and the like, for either continuous or batch type operation. The improved impeller described herein provides effective defibering at low power consumption and minimizes cavitation at high stock consistencies.

This specification discloses an impeller for use in association with an extraction plate adapted for defibering liquid slurry stock and causing defibered material to pass through the extraction plate. The impeller includes a central body portion and a plurality of vanes extending outwardly from the central body portion. The vane leading face height from an extraction side to an air foil surface is constant from the vane outer end to where the vane is attached to the central body portion at the radially outward edge of the central body portion, and then thereafter gradually decreasing in height from the radially outward edge of the body central portion to the airfoil surface at the vane inner end. "Constant" as used herein means substantially or essentially constant, without significant variation.

Figure 1:
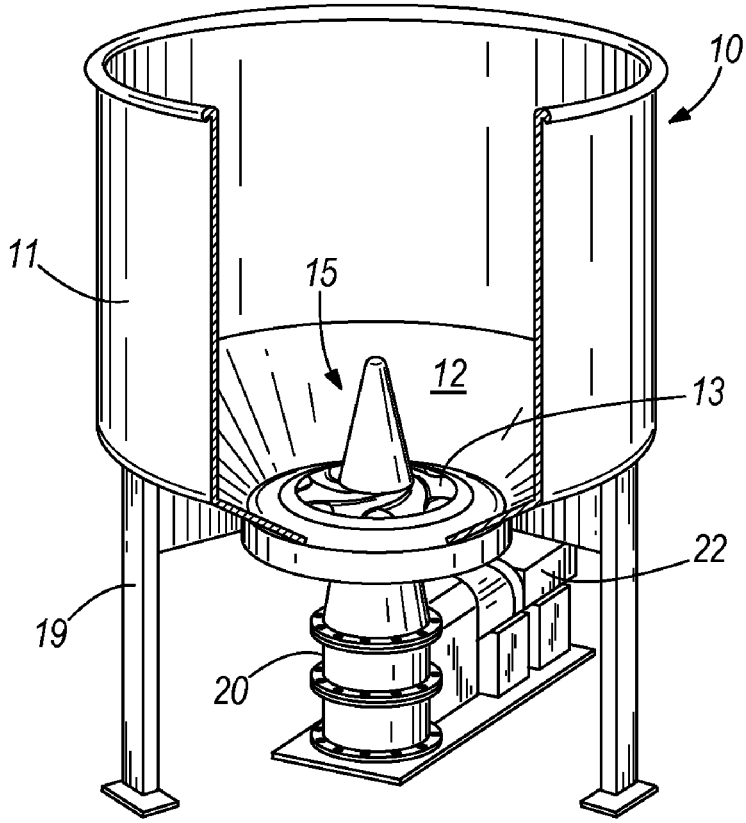
FIG. 1 PRIOR ART
FIG. 1 illustrates a conventional pulper.
Figure 2:
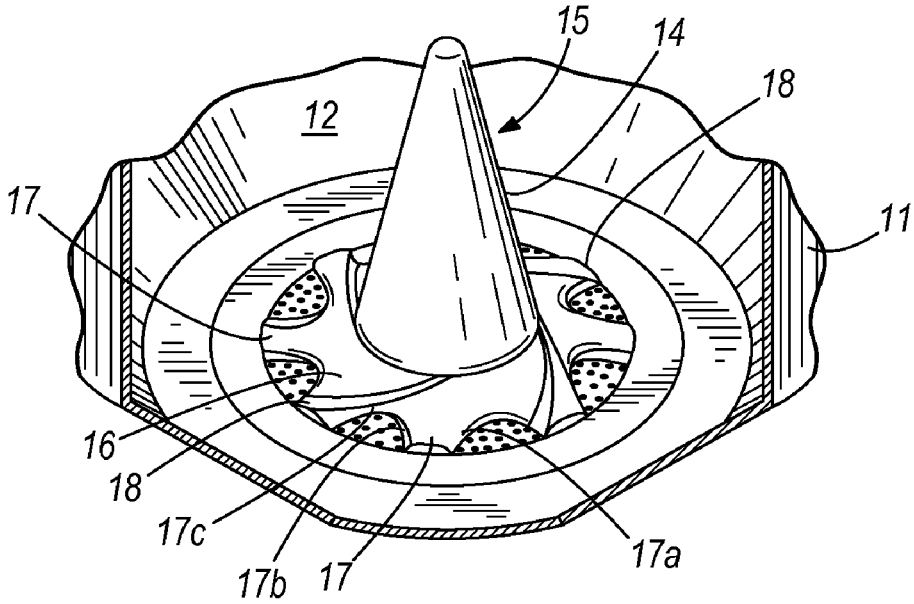
FIG. 2 PRIOR ART
FIG. 2 illustrates a conventional impeller.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience in reference to the drawings and are not to be construed as limiting terms.

DETAILED DESCRIPTION OF THE PREFERRED EMBODIMENT

Figure 3:
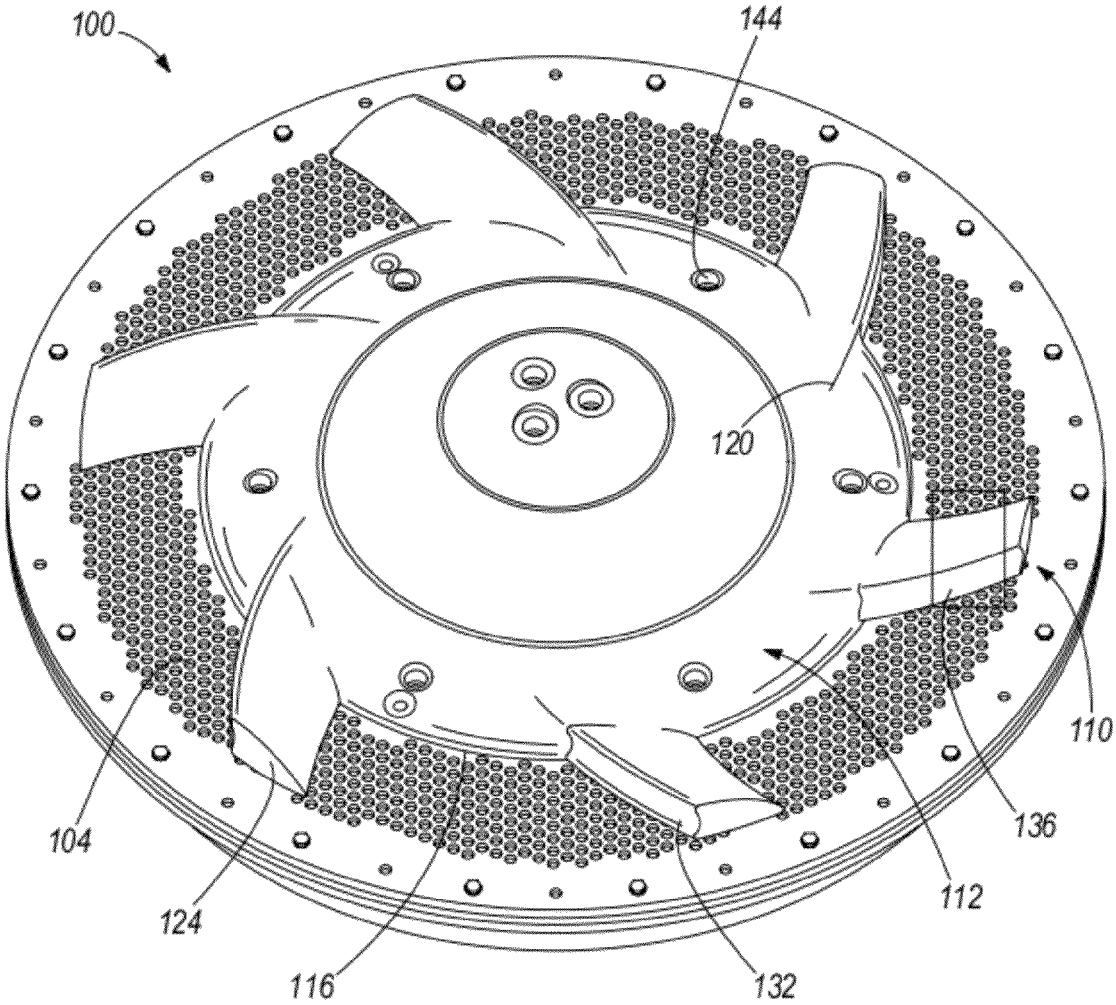
FIG. 3 is a perspective view of an improved mixing impeller.

As illustrated in FIG. 3, the impeller 100 of this disclosure is used in association with a strainer grate 104. The impeller 100 and strainer grate 104 defiber liquid slurry stock and cause defibered material to pass through the strainer grate 104. As illustrated in FIG. 3, when installed in a conventional manner in a defibering apparatus (not shown), the impeller 100 has vanes 110 that are coextensive with the strainer grate 104.

The impeller 100 includes a cylindrical central body portion 112. The cylindrical central body portion 112 is generally flat and has a radially outward edge 116. The impeller 100 also includes the plurality of equally spaced apart vanes 110 that extend outwardly from the central body portion 112. Each vane 110 has an inner end 120 attached to the central body portion 112 within the radially outward edge 116 of the central body portion 112. Each vane 110 also has an outer end 124, and each vane 110 is angled back in a reverse flow direction from a radial line from where the main inner end is attached to central body portion 112. The angle can be between 40 degrees and 55 degrees, but is preferably about 45 degrees.

Figure 4:
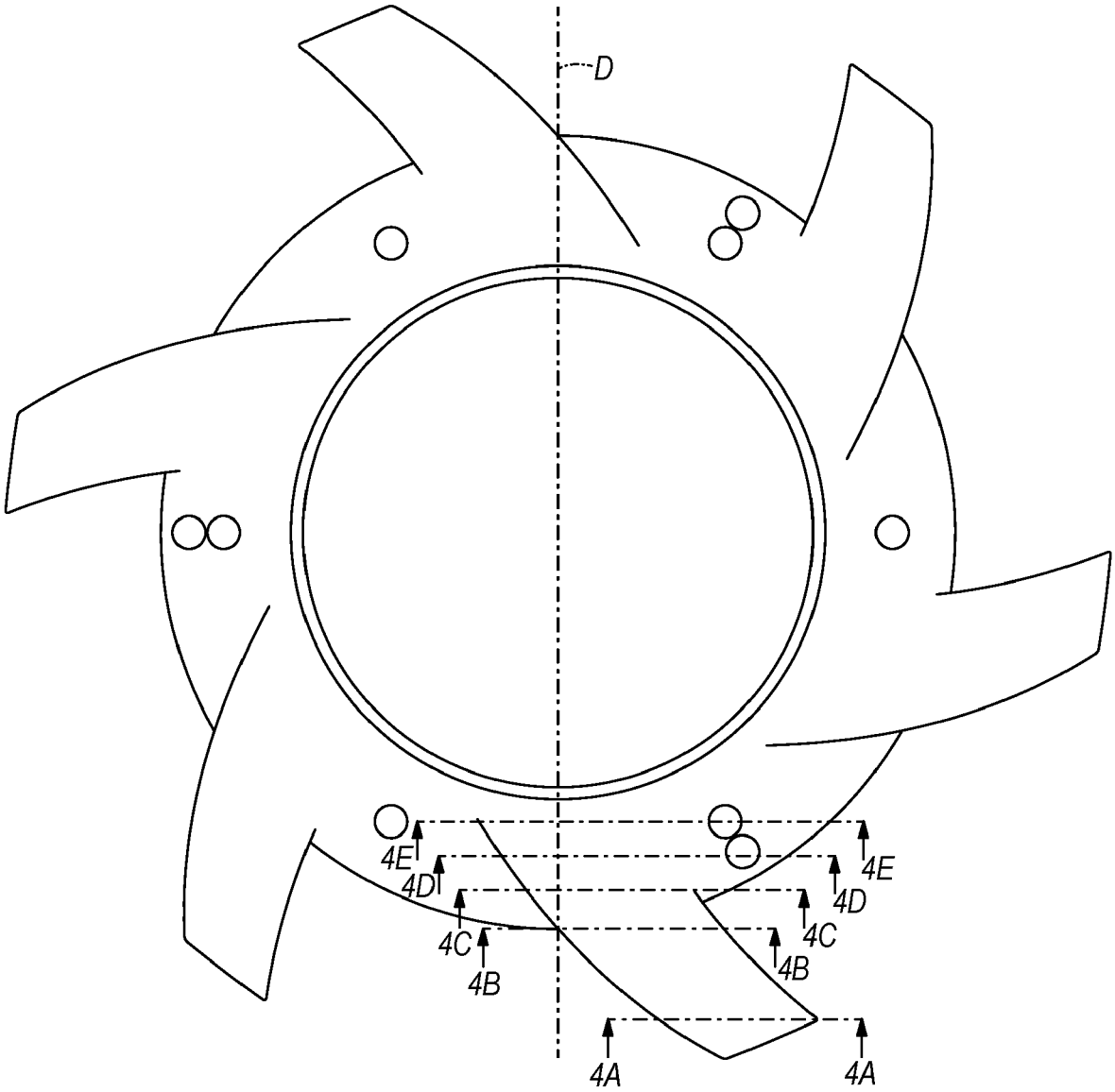
FIG. 4 is a top view of the impeller shown in FIG. 3.

As shown in FIGS. 3 and 4 A, each impeller vane 110 also has a relatively flat extraction side 128, a curved leading face 132 and a curved trailing edge 136. Each vane 110 also has a smoothly contoured convex airfoil trailing surface 140 extending from the leading face 132 to the trailing edge 136. The vane leading face 132 height H from the extraction side 128 to the airfoil surface 140 is constant from the vane outer end 124 to where the vane 110 is attached to the central body portion 112 at the radially outward edge 116 of the central body portion 112. Each vane 110, after reaching the radially outward edge 116 of the central body portion 112, decreases in height from the radially outward edge 116 to the airfoil surface 140 at the vane inner end 120.

In the preferred embodiment, the ratio of the rotor diameter D (see FIG. 4) to the vane height H is less than about 20 to 1. And, still more particularly, the ratio of the rotor diameter D to vane height H is about 16 to 1.

In the preferred embodiment, the vane leading face 132 has a concave trough like surface extending for substantially the entire length of the vane 110. Each vane trailing edge 136 is curved, and the outer end 124 of each vane 110 is blunt. Openings 144 are provided through the cylindrical central body portion 112 for attaching the impeller 100 to a motor drive shaft (not shown). In other less preferred embodiments (not shown), the vanes 110 can be straight and angled back and the leading faces 132 of the vanes 110 can be flat rather than concave.

Figure 4A:
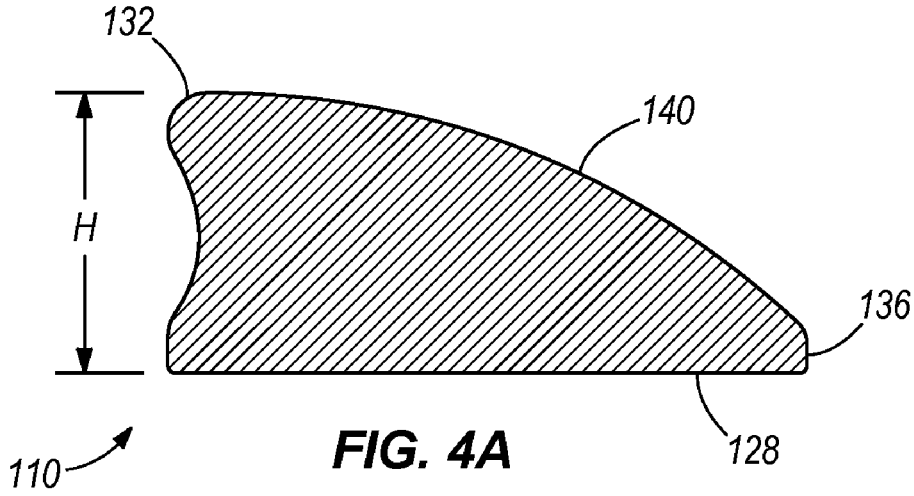
FIG. 4A is a cross-section of the impeller vane shown in FIG. 4, taken along the line A-A in FIG. 4.
Figure 4B:
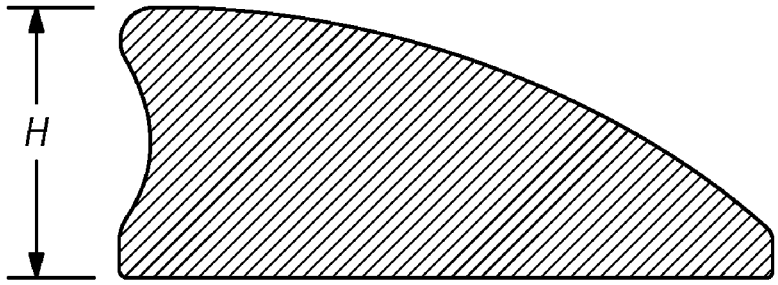
FIG. 4B is a cross-section of the impeller vane shown in FIG. 4, taken along the line B-B in FIG. 4.
Figure 4C:
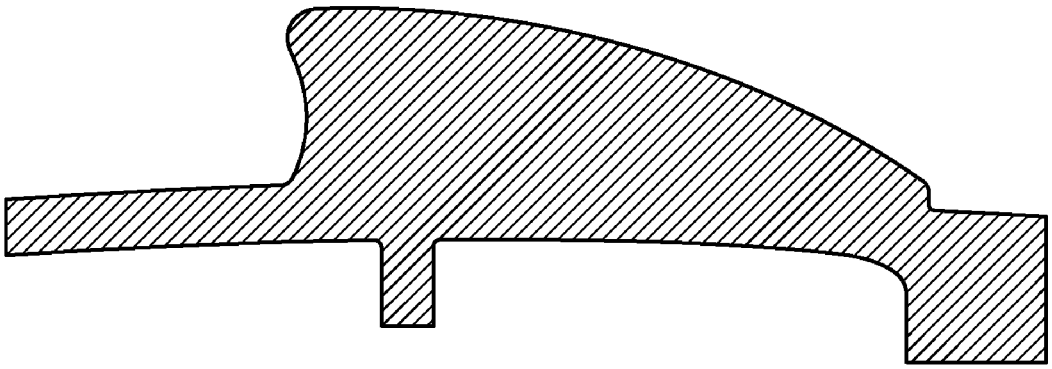
FIG. 4C is a cross-section of the impeller vane shown in FIG. 4, taken along the line C-C in FIG. 4.
Figure 4D:
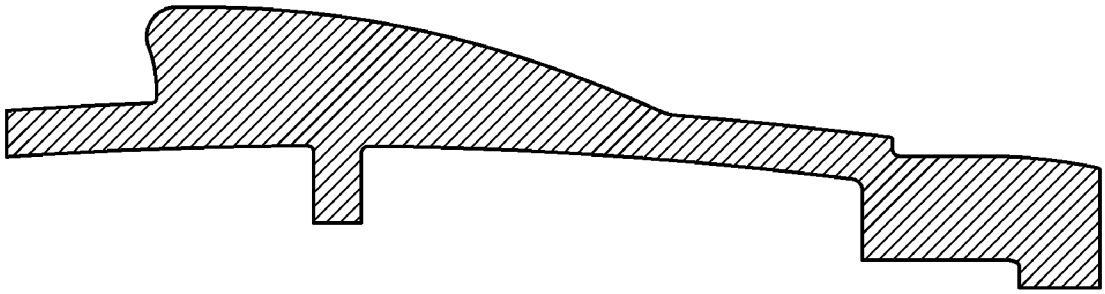
FIG. 4D is a cross-section of the impeller vane shown in FIG. 4, taken along the line D-D in FIG. 4.
Figure 4E:
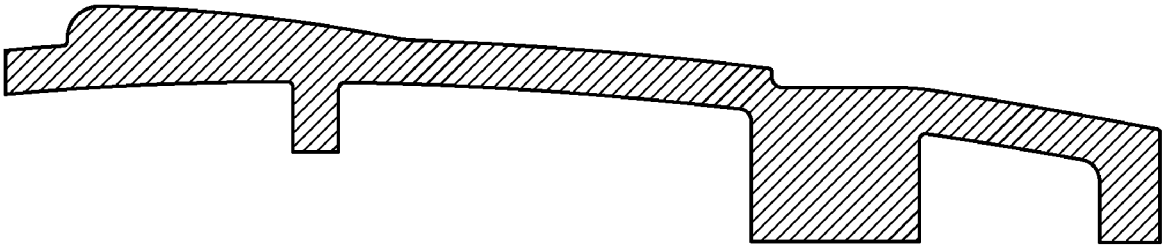
FIG. 4E is a cross-section of the impeller vane shown in FIG. 4, taken along the line E-E in FIG. 4.

More particularly, by referring to the progression of the vane 110 cross-sections shown in FIGS. 4A, 4B, 4C, 4D, and 4 E, the constant height of the vanes is clearly shown by the constant dimension H shown in FIGS. 4A and 4B, while the height reduces, as it approaches the inner end of the vane 110, as shown in FIGS. 4C, 4D, and 4E.

This impeller 110 was designed to provide more efficient defibering (shorter pulping time) and better tank circulation with lower energy usage thus saving the user energy. The multiple vanes 110 are curved and swept back to reduce hydraulic drag (saving energy) yet still impart radial momentum to the stock to ensure good tank circulation. The leading face 132 of the vanes 110 are concave, which generates areas of rotation ahead of the vanes 110 to bring fresh stock into the shear zone at the interface between of the leading edge of the vane 110 and the stationary strainer grate 104 located below the impeller 110. This provides more efficient defibering of the raw material. The inboard areas of the vanes 110, where they blend and attach to the central hub or body portion 112, are reduced in height to offer less drag and reduce energy usage.

The top surfaces of the vanes 110 are airfoil shaped to draw material down from above to be processed by the following vane and prevent cavitation. The vanes 110 are sufficiently long to sweep the entire perforated area of the strainer grate located beneath it.

Various other features and advantages of the invention will be apparent from the following claims.

The invention claimed is:

1. An impeller for use in association with an extraction plate adapted for defibering liquid slurry stock and causing defibered material to pass through said extraction plate, said impeller comprising:

a central body portion having a radially outward edge;

a plurality of vanes extending outwardly from said central body portion, each vane having an inner end attached to said central body portion within said radially outward edge, and an outer end, a relatively flat extraction side, a leading face, and a trailing edge, a smoothly contoured convex airfoil trailing surface extending from said leading face to the trailing edge, the vane leading face height from the extraction side to the air foil surface being substantially constant from the vane outer end to where the vane is attached to said central body portion at the radially outward edge of the central body portion, and the vane leading face height then thereafter gradually decreasing in height from the radially outward edge of the body central portion to the airfoil surface at the vane inner end.

2. An impeller in accordance with claim 1 wherein said central body portion is relatively flat.

3. An impeller in accordance with claim 1 wherein the leading face has a concave trough-like surface extending for substantially the entire length of the vane.

4. An impeller in accordance with claim 1 wherein the leading face is curved in the radial direction.

5. An impeller in accordance with claim 1 wherein the trailing edge is curved in the radial direction.

6. An impeller in accordance with claim 1 wherein each vane is angled back in a reverse flow direction from a radial line from where the main inner end is attached to central body portion.

7. An impeller in accordance with claim 6 wherein said angle is between 40 degrees and 55 degrees.

8. An impeller in accordance with claim 6 wherein said angle is about 45 degrees.

9. An impeller in accordance with claim 1 wherein the ratio of the rotor diameter to the vane height is less than about 20 to 1.

10. An impeller in accordance with claim 9 wherein the ratio of the rotor diameter to the vane height is about 16 to 1.

* * * * *